US010856678B2

(12) United States Patent
Vitale

(10) Patent No.: US 10,856,678 B2
(45) Date of Patent: Dec. 8, 2020

(54) METHOD OF MAKING A FITTED SHEET

(71) Applicant: JLJ Home Furnishings LLC, Lancaster, SC (US)

(72) Inventor: Rory D. Vitale, Charlotte, NC (US)

(73) Assignee: JLJ Home Furnishings LLC, Lancaster, SC (US)

( * ) Notice: Subject to any disclaimer, the term of this patent is extended or adjusted under 35 U.S.C. 154(b) by 0 days.

(21) Appl. No.: 15/988,007

(22) Filed: May 24, 2018

(65) Prior Publication Data

US 2018/0263388 A1 Sep. 20, 2018

Related U.S. Application Data

(62) Division of application No. 13/549,583, filed on Jul. 16, 2012, now abandoned.

(60) Provisional application No. 61/523,744, filed on Aug. 15, 2011.

(51) Int. Cl.
*A47G 9/02* (2006.01)

(52) U.S. Cl.
CPC ..... *A47G 9/0246* (2013.01); *Y10T 29/49826* (2015.01); *Y10T 156/1052* (2015.01)

(58) Field of Classification Search
USPC ..... 5/482, 486, 488, 497, 495, 498, 499
See application file for complete search history.

(56) References Cited

U.S. PATENT DOCUMENTS 2,528,313 A 10/1950 Kessler
2,569,627 A 10/1951 Black
2,624,893 A 1/1953 Harris
2,639,444 A 5/1953 Monsabert
2,942,280 A 6/1960 May, Jr.
3,017,740 A * 1/1962 Humphreys ..... D02G 3/324 57/12
3,273,175 A 9/1966 Anderson et al.
3,290,702 A 12/1966 Seltzer
3,789,441 A 2/1974 Weiss
4,672,702 A * 6/1987 Isham ..... A47G 9/02 5/497
4,985,953 A 1/1991 Seago
5,056,441 A * 10/1991 Seago ..... A47C 31/105 112/163
5,127,115 A 7/1992 Williams et al.
5,249,322 A * 10/1993 Seago ..... A47G 9/0246 112/163
5,271,112 A 12/1993 Bible et al.
(Continued)

*Primary Examiner* — Richard G Davis

(74) *Attorney, Agent, or Firm* — Hammer & Associates, P.C.

(57) ABSTRACT

A method of making a fitted sheet includes the steps of: affixing a plurality of elastic members along the lateral side edge portions of a sheet material, cutting the sheet material to a pre-determined length, cutting out corners from the sheet material of a pre-determined length, and forming corners in the sheet material of pre-determined length by affixing edge portions of the corners. A fitted sheet has a top portion with two lateral side panels and two end side panels. Each side panel may be at an angle to the top portion. Each side panel has lateral edge portions. The lateral edge portion of one side panel may be affixed to the lateral edge portion of the adjacent side panel. A plurality of elastic members is affixed to opposing side panels. No plurality of elastic members is affixed to the other side panels.

7 Claims, 3 Drawing Sheets

(56) References Cited

U.S. PATENT DOCUMENTS

| | | | | |
|---|---|---|---|---|
| 5,287,574 | A * | 2/1994 | Kardell | A47G 9/0246 5/497 |
| 5,325,555 | A | 7/1994 | Whitley | |
| 5,530,979 | A | 7/1996 | Whitley | |
| 5,542,137 | A | 8/1996 | Byfield | |
| 5,636,393 | A * | 6/1997 | Zafiroglu | A47G 9/0246 428/102 |
| 5,809,593 | A | 9/1998 | Edwards | |
| 5,996,148 | A | 12/1999 | McCain et al. | |
| 6,499,157 | B1 * | 12/2002 | McCain | A47C 31/105 5/497 |
| 7,007,326 | B2 * | 3/2006 | Tsiarkezos | A47C 27/002 5/497 |
| 7,398,570 | B2 * | 7/2008 | Seago | A47G 9/0246 5/497 |
| 2002/0112510 | A1 * | 8/2002 | Freedman | D04B 1/18 66/202 |
| 2008/0078029 | A1 * | 4/2008 | Seago | A47G 9/0246 5/499 |
| 2008/0202665 | A1 | 8/2008 | Seago | |

* cited by examiner

Fig. 1
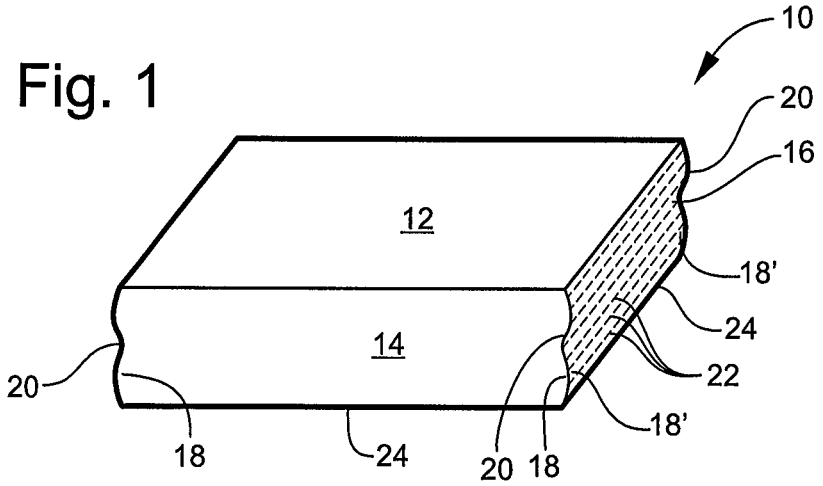
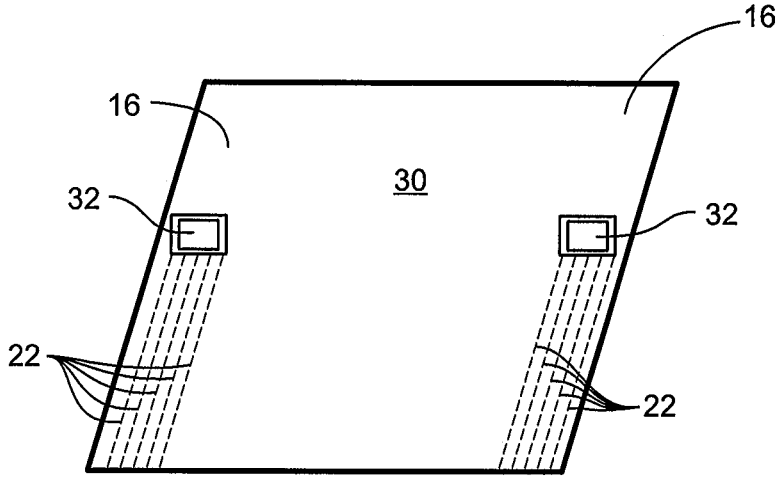
Fig. 2
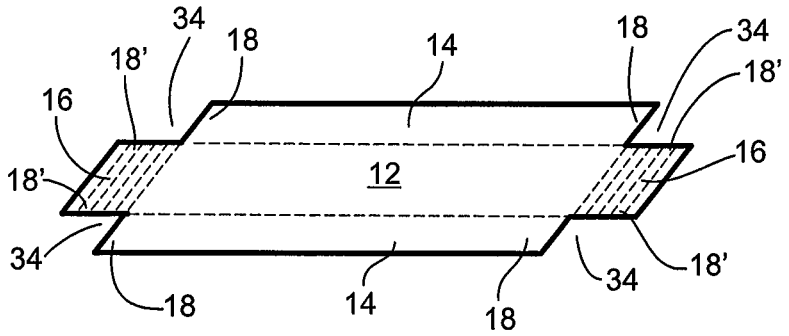
Fig. 3

METHOD OF MAKING A FITTED SHEET

RELATED APPLICATIONS

This application is a divisional application claiming the benefit of co-pending U.S. patent application Ser. No. 13/549,583 filed Jul. 16, 2012, which claimed the benefit of U.S. Provisional patent application Ser. No. 61/523,744 filed Aug. 15, 2011, both of which are incorporated herein by reference.

FIELD OF THE INVENTION

This application is directed to a method of making a fitted sheet.

BACKGROUND OF THE INVENTION

A fitted sheet is a sheet fitted for a mattress, it usually has an elastic band sewn into its hem along the bottom edge of the fitted sheet.

U.S. Pat. No. 4,985,953 (also related to U.S. Pat. No. 5,056,441 and U.S. Pat. No. 5,249,322) and U.S. Pat. No. 7,398,570 (also related to US Publication US2008/020665) are directed to fitted mattress covers. In U.S. Pat. No. 4,985,953, a plurality of elastic bands is sewn into the skirt surrounding the top panel. In U.S. Pat. No. 7,398,570, the end panels include an elastic composite panel located at the lower portion of the end panels

SUMMARY OF THE INVENTION

A method of making a fitted sheet includes the steps of: affixing a plurality of elastic members along the lateral side edge portions of a sheet material, cutting the sheet material to a pre-determined length, cutting out corners from the sheet material of a pre-determined length, and forming corners in the sheet material of pre-determined length by affixing edge portions of the corners. A fitted sheet has a top portion with two lateral side panels and two end side panels. Each side panel may be at an angle to the top portion. Each side panel has lateral edge portions. The lateral edge portion of one side panel may be affixed to the lateral edge portion of the adjacent side panel. A plurality of elastic members is affixed to opposing side panels. No plurality of elastic members is affixed to the other side panels.

DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 1 is an isometric illustration of an embodiment of the instant invention.

FIG. 2 is a representation of a part of a method of manufacturing the instant invention.

FIG. 3 is a further representation of another part of the method seen in FIG. 2.

DESCRIPTION OF THE INVENTION

Figure 4:
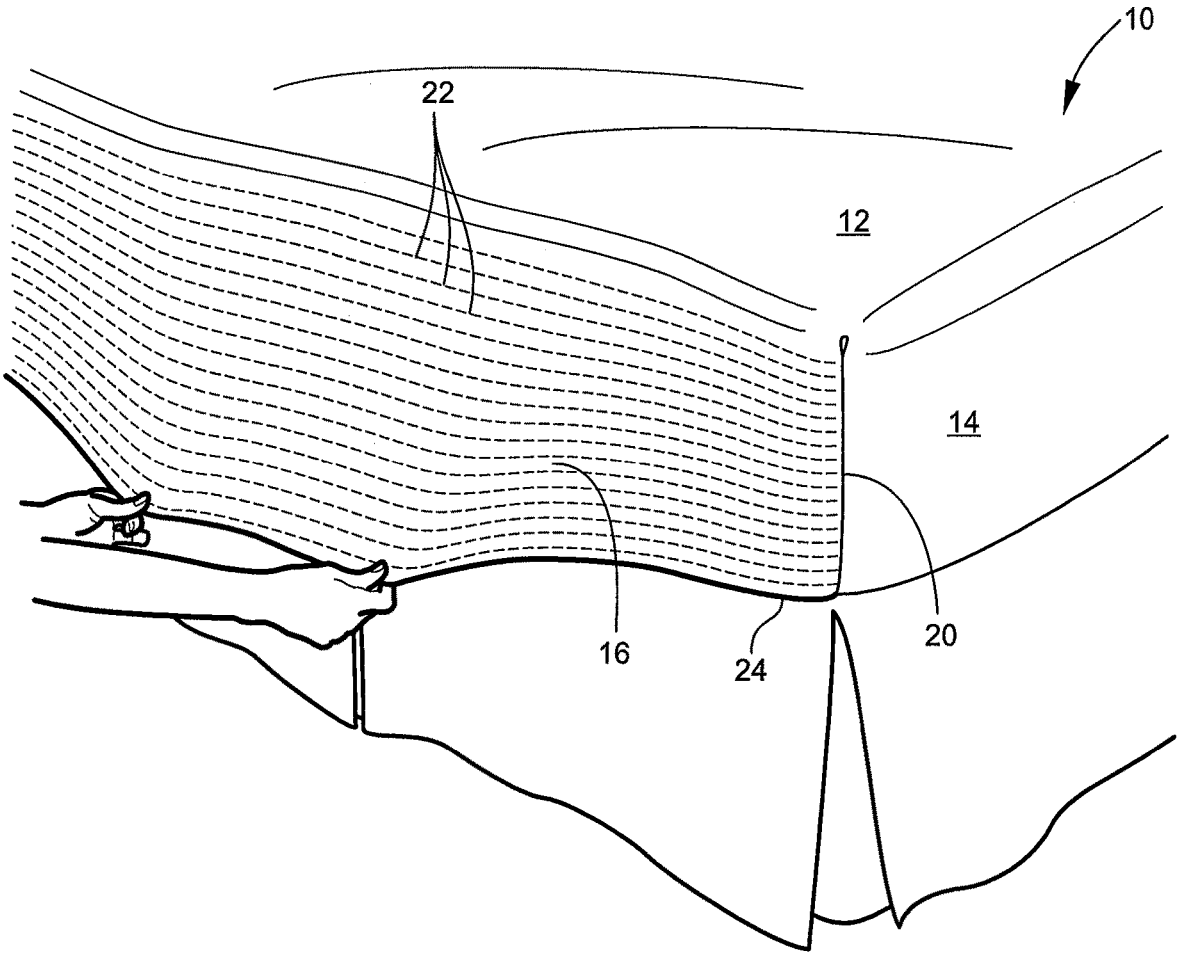
FIG. 4 is an environmental view of a portion of an embodiment of the invention being placed over a mattress.

Referring to the drawings, wherein like numerals indicate like elements, there is shown in FIG. 1 an embodiment of the fitted sheet 10. The sheet 10 may be a woven material, but is not so limited, as is customary is such applications and is well known to those of ordinary skill in the art. In other embodiments, the sheet 10 may be a nonwoven or knit material. Most often the sheet material may be cotton, cotton/polyester blend, and/or polyolefin, as is known to those of ordinary skill in the art.

The invention, while primarily directed to a fitted sheet, may also include alternate embodiments, for example, mattress pads and mattress covers.

Fitted sheet 10 may include a top portion 12, a lateral side portion 14, in FIG. 1 the opposing lateral side portion 14 is not shown, and an end side portion 16, in FIG. 1 the opposing end side portion 16 is not shown. In general, the end side portions 16 correspond to the head and foot of a bed and the lateral side portions correspond to the sides of the bed. Thus, in general, the lateral side portions 14 may be longer than the end side portions 16. In one embodiment, the side portions 14/16 may be integral with top portion 12. In another embodiment, the side portions 14/16 may be affixed to the top portions 12. In another embodiment, side portion 14 may be integral with top portion 12 and side portion 16 affixed to top portion 12 or vice versa.

The side portions 14/16 depend from the top portion 12 at an angle. In one embodiment that angle may be a right angle.

One edge portion 18 of the lateral side 14 is affixed to a mating edge portion 18' of end side 16 to form corner 20. This is how each of the corners 20 is formed.

An elastic edge 24 may be disposed and affixed along the bottom-most (or peripheral) edge of the side panels 14/16. Elastic edge 24 may be adapted to draw the peripheral edge under, for example, a mattress.

The end side portions 16 may have at least one elastic member 22 affixed thereto in a generally horizontal orientation (e.g., extending from one corner 20 to the next). However, in other embodiments, the elastic members 22 may be at other orientations, so long as the corners 20 of the end side portions 16 are drawn together. In one embodiment, there may be a plurality of elastic members 22. A plurality may be 4, 5, 6, 7, 8, 9, or more elastic members 22. Each is generally linear and parallel to the others; but in other embodiments, the elastic members may be in crossed, angled, and/or undulating (e.g., sinusoidal) orientations, so long as the corners 20 of the end side portions 16 are drawn together. When the end side portions 16 include at least one elastic member 22, then the lateral side portions 14 include no elastic members (with the exception of the optional elastic edge 24 mentioned above).

In an alternate embodiment (not shown), the lateral side portions 14 may have at least one elastic member 22 affixed thereto in a generally horizontal orientation (e.g., extending from one corner 20 to the next). However, in other embodiments, the elastic members 22 may be at other orientations, so long as the corners 20 of the lateral side portions 14 are drawn together. In one embodiment, there may be a plurality of elastic members 22. A plurality may be 4, 5, 6, 7, 8, 9, or more elastic members 22. Each is generally linear and parallel to the others; but in other embodiments, the elastic members may be in crossed, angled, and/or undulating (e.g., sinusoidal) orientations, so long as the corners 20 of the lateral side portions 16 are drawn together. When the lateral side portions 14 include at least one elastic member 22, then the end side portions 16 include no elastic members (with the exception of the optional elastic edge 24 mentioned above).

In one embodiment, the elastic members 22 may be core-spun yarns. Core-spun yarn, as used herein, may refer to a yarn made by twisting staple around an elastic filament. The staple (e.g., cotton, polyester, and/or a blend thereof) may be from 250-50 denier, from 200-100 denier, or preferably about 150 denier. The elastic filament may be from 60-30 gauge, or preferably 52-38 gauge. In other embodiments, the elastic member 22 may be an elastic tape, strand, and/or filament. The elastic member may have a stretch ratio of 3.5-1.0 inches to 1 inch, the stretch ratio may be in the range of 3.0-1.5" to 1", or preferably the elastic member has a stretch ratio of 2-1.5" to 1". The elastic member may have a shrinkage less than 10%, less than or equal to 7%, or preferably about 5% or less. In another embodiment, elastic members of various stretch ratios are used. In one embodiment, the elastic members with the greatest stretch ratios are located at the lower-most edge of the end side portion (and become progressive lower as one moves up the end portion) and in another they are located at the upper-most edge of the end side portion (and become progressive lower as one moves down the end portion). Elastic member 22 may be made of any elastic material (elastomer). Such elastomers include, but are not limited to, natural rubber, styrene-butadiene copolymer polychloroprene, nitrile rubber, butyl rubber, polysulfide rubber, poly isoprene, ethylene-propylene terpolymers, silicone rubber, polyurethane rubber, styrenic block copolymers, mixtures thereof, and the like.

Affixed, as used herein, may mean sewing, hemming, gluing, ultrasonic bonding, thermal bonding, or the like, and combinations thereof. Each of these operations is understood by those of ordinary skill in the art.

Referring to FIGS. 2 and 3, one method of manufacturing one embodiment of the instant invention is illustrated. In FIG. 2, sheet 30, for example from a roll or a bolt (not shown), may be unrolled or unfurled. The elastic members 22 are affixed to the end side portions 16 (which are the lateral edge portions of the sheet 30). In one embodiment the elastic members 22 are under tension (e.g., elongated) while affixed; so that when un-tensioned the material of end side portions gather about the elastic members 22 (not shown). The mechanism for affixing 32 being conventional, as understood by those of ordinary skill.

In FIG. 3, sheet 30 has been cut to length (e.g., length of top portions 12 plus the width of two lateral side portions 14). Additionally, corner cut-outs 34 have been removed. These cut-outs may be slightly longer than the desired length of the end side portions to allow for the gathering of material when the elastic members are affixed to the end side portions. Thereafter, the corners 20 are formed by affixing the edge portion of one side portions to the adjacent edge portions of the mating side portion. Finally, the elastic edge may be affixed to the lower-most edge of the side portions.

Figure 5:
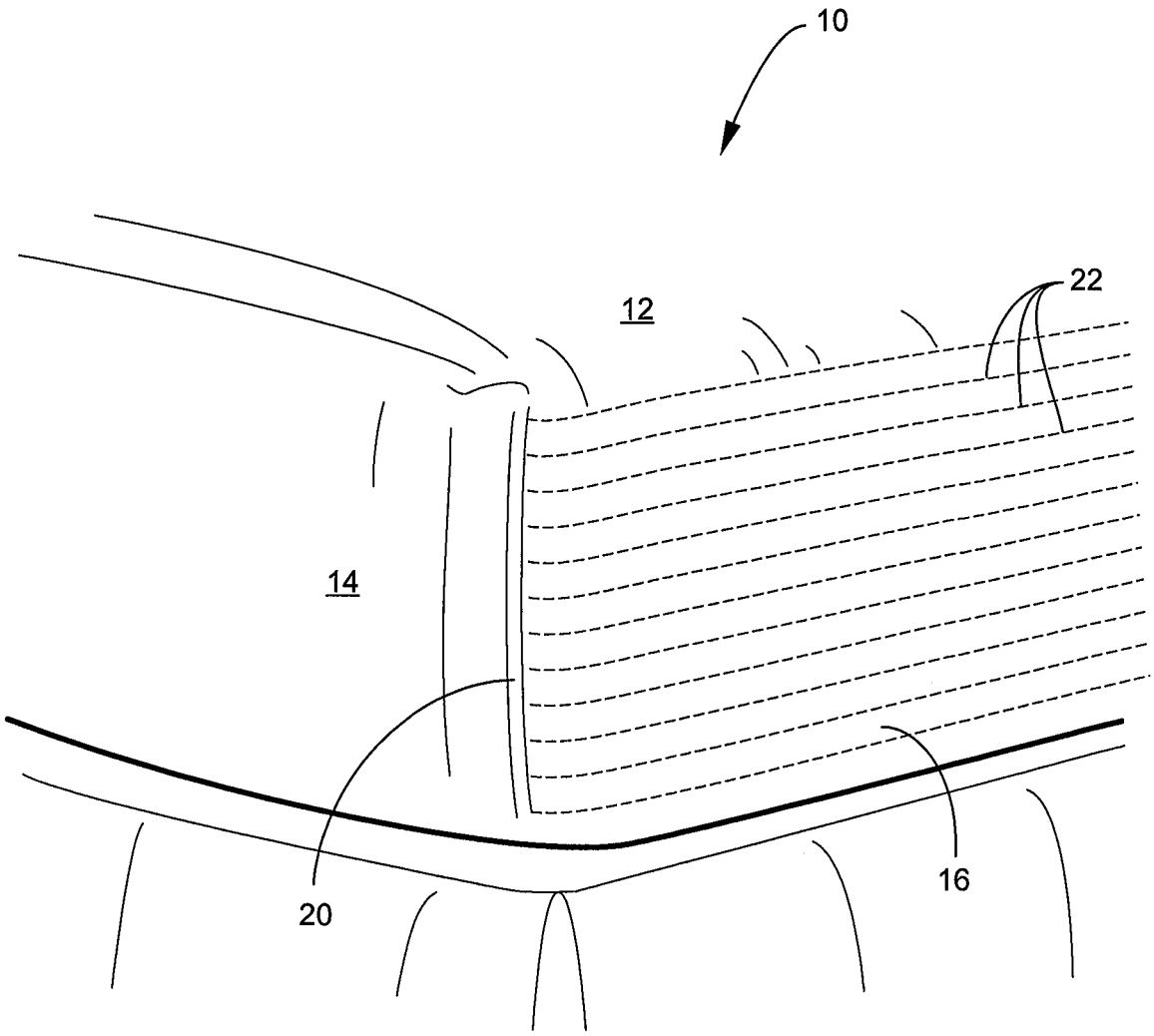
FIG. 5 is another environmental view of a portion of an embodiment of the invention in place over a mattress.

In FIGS. 4 and 5, the fitted sheet 10 is illustrated in use over a mattress. In FIG. 4, the fitted sheet 10 is being pulled into place over the mattress. In FIG. 5, the fitted sheet 10 is in place on the mattress.

The present invention may be embodied in other forms without departing from the spirit and the essential attributes thereof, and, accordingly, reference should be made to the appended claims, rather than to the foregoing specification, as indicating the scope of the invention.

I claim:

1. A method of making a fitted sheet comprising consisting of the steps of:

unrolling a sheet material from a roll or bolt;

affixing a plurality of elastic core-spun filaments only along the end side edge portions of the sheet material and not affixing any elastic core-spun filaments on lateral side portions of the sheet material, cutting the sheet material to a pre-determined length, cutting out corners from the sheet material of a the pre-determined length, forming corners in the sheet material of the pre-determined length by affixing edge portions of the corners; and affixing an elastic edge around the lower-most edge of the fitted sheet.

2. The method of claim 1 wherein affixing the plurality of elastic core-spun filaments being selected from the group consisting of sewing, hemming, gluing, ultrasonic bonding, thermal bonding, and combinations thereof.

3. The method of claim 1 wherein affixing the edge portions being selected from the group consisting of sewing, hemming, gluing, ultrasonic bonding, thermal bonding, and combinations thereof.

4. The method of claim 1 wherein affixing the elastic edge being selected from the group consisting of sewing, hemming, gluing, ultrasonic bonding, thermal bonding, and combinations thereof.

5. The method of claim 1 further comprising the step of:

tensioning the elastic core-spun filaments prior to affixing the plurality of elastic members to the sheet material.

6. The method of claim 1 wherein the elastic core-spun filaments number 14 or more.

7. A method of making a fitted sheet comprising consisting of the steps of:

unrolling a sheet material from a roll or bolt;

affixing and tensioning a plurality of elastic core-spun filaments only along the end side edge portions of a sheet material and not affixing any elastic core-spun filaments on lateral side portions of the sheet material, the elastic members number at least 12, affixing the plurality of elastic core-spun filaments by a method selected from the group consisting of sewing, hemming, gluing, ultrasonic bonding, thermal bonding, and combinations thereof, cutting the sheet material to a pre-determined length, cutting out corners from the sheet material of a pre-determined length, forming corners in the sheet material of pre-determined length by affixing edge portions of the corners, affixing the edge portions by a method selected from the group consisting of sewing, hemming, gluing, ultrasonic bonding, thermal bonding, and combinations thereof, and affixing an elastic edge around the lower-most edge of the fitted sheet.

* * * * *